United States Patent [19]

Meek

[11] Patent Number: 4,476,705

[45] Date of Patent: Oct. 16, 1984

[54] AUTOMOBILE BODY DENT PULLER

[76] Inventor: James S. Meek, 3303 Lockwood Dr., Chattanooga, Tenn. 37415

[21] Appl. No.: 460,151

[22] Filed: Jan. 24, 1983

[51] Int. Cl.[3] ..... B21D 1/06

[52] U.S. Cl. ..... 72/478; 72/480; 72/705; 294/97

[58] Field of Search ..... 411/347, 351, 352, 530, 411/516; 294/86 R, 93, 97; 72/457, 478, 705, 479, 480

[56] References Cited

U.S. PATENT DOCUMENTS

| | | | |
|---|---|---|---|
| 3,582,126 | 6/1971 | Bladholm | 294/97 |
| 3,645,160 | 2/1972 | Artioli et al. | 411/347 |
| 4,289,017 | 9/1981 | Guidry | 72/478 |

FOREIGN PATENT DOCUMENTS

| | | | |
|---|---|---|---|
| 68075 | 9/1929 | Sweden | 411/530 |
| 481541 | 3/1938 | United Kingdom | 411/351 |

*Primary Examiner*—Lowell A. Larson
*Attorney, Agent, or Firm*—Alan Ruderman

[57] ABSTRACT

A tool for straightening indentations in sheet metal has a pair of substantially L-shaped rods, one leg of one of the rods being mounted concentrically within a corresponding leg of the other of the rods for movement axially along and rotatable about the common axis. The second leg of the outer rod has a recess shaped for receiving the corresponding second leg of the inner rod so that in a first position the second leg of the inner rod may be nestled within the second leg of the outer rod to provide a cross-sectional profile less than the composite of the two rods and both may be inserted and removed as a unit into and from a hole formed in the sheet metal. The inner rod may thereafter be rotated 180 degrees about the common axis and locked in position for applying a pulling force against the sheet metal. A spring detent locking pin secures the rods in the pulling disposition and also in the insertion/removal disposition of the rods. The detent is a prong-like spring member disposed within an axial bore of the pin and has a pair of spaced protrusions extending beyond the diameter of the pin through a bore extending diametrically through the pin.

18 Claims, 6 Drawing Figures

AUTOMOBILE BODY DENT PULLER

BACKGROUND OF THE INVENTION

This invention relates to a sheet metal working tool and more particularly to a tool for pulling out dents from automobile sheet metal bodies.

When access is available to only one side of a damaged automotive sheet metal body, a tool capable of pulling from the blind side must be utilized. Conventional tools for this purpose and the difficulties presented by the known prior art devices are enumerated in my prior U.S. Pat. No. 4,300,382 dated Nov. 17, 1981. To overcome these difficulties my aforesaid patent proposed a tool for straightening indentations in sheet metal which included a pair of levers each having first and second legs disposed angularly to one another and pivotably connected together such that the levers could be pivoted from a position in which the axes of the first legs are superposed upon each other for insertion of both first legs simultaneously into a hole formed in the sheet metal for receiving the legs, and thereafter pivoted to a second position in which the first legs face in opposite directions from the pivot for engaging the sheet metal at opposite directions across the hole. A pulling force may thereafter be exerted along the second legs to pull out the dent. Although that device functions satisfactory, one problem limiting acceptance of the device is that the size of the hole required for insertion of the first legs is larger than is desirable because the legs must be of sufficient thickness, at least at the location of the pivotable connection, to withstand the pulling force.

SUMMARY OF THE INVENTION

Consequently, it is a primary object of the present invention to provide an improved version of the sheet metal dent puller of U.S. Pat. No. 4,300,382 which can operate from the blind side through a very small entry opening formed in the dent.

It is another object of the present invention to provide a sheet metal dent pulling tool having a pair of work engaging members, the members being mounted along a common axis and pivotable relatively to one another about said axis from a superposed disposition to a disposition facing substantially oppositely to each other, and means for permitting a pulling force to be applied along the common axis.

It is a further object of the present invention to provide a sheet metal indentation straightening tool having a pair of substantially L-shaped members, the members being mounted along an axis common to one of the legs of both members and rotatable relatively to one another about said axis, the other legs of said members being constructed such that in a first position the legs may be nestled together to form a profile less than that which would result from the combined profile of the two members.

It is a still further object of the present invention to provide a sheet metal indentation straightening tool having a pair of substantially L-shaped members, one leg of one of the members being mounted concentrically within a corresponding leg of the other member and being moveable along and rotatable about the common axis relative to the other member, the second leg of the outer member having a recess shaped for receiving the corresponding second leg of the inner member for entry of both second legs into a hole formed in the dent, whereby the inner member may thereafter be translated along the common axis to disengage the second legs and permit the inner member to be rotated about said axis until the second legs are disposed substantially oppositely to each other and then translatably positioned such that a surface of both second legs are coplanar for engaging the sheet metal at opposite sides of the hole.

It is a yet further object of the present invention to provide a locking pin for entry into aligned openings in a pair of members for locking the two members together, whereby the locking pin may be provided to lock together a pair of concentrically mounted work engaging members of a dent pulling tool, the members being moveable along and about the common axis relative to one another and having a pair of legs disposed angularly relatively to said axis, whereby the locking pin may lock the members together in a disposition in which the angularly disposed legs extend oppositely to one another.

In accordance with the present invention the sheet metal indentation straightening tool comprises a pair of members having first legs elongated along a common axis, and second legs disposed at substantially the same angle relative to the axis. The first leg of one member is disposed within the first leg of the other member for relative rotation about the common axis and for relative translation therealong. The second leg of the outer member is formed for receiving at least a transverse portion of the second leg of the inner member when the members are positioned with the second legs extending in the same direction. Thus, the second leg of the inner member may be nestled within the second leg of the outer member and the resulting cross-sectional profile of both second legs when so disposed is substantially smaller than the total cross-sectional profile of both second legs.

Preferably, the members have a substantially circular cross-sectional configuration and the second leg of the outer member is arcuately recessed sufficiently such when the second leg of the inner member is disposed therein the resulting profile may be no greater than that of the second leg of the outer member. When the second leg of the inner member is disposed within the second leg of the outer member both second legs may be readily inserted together into a small hole formed in the dent. The second legs may thereafter be separated for relative rotation to a position where they extend in opposite directions and translated along the axis to the same plane for engaging the sheet metal across the hole. The legs may thereafter be locked together and a pulling force applied along the axis to effect deformation of the sheet metal by the second legs.

In the preferred embodiment the outer member is secured to the inside of an outer housing and the inner member is fastened to an inner housing relatively moveable, within the outer housing, and the housings may be locked together in both the position in which the members are disposed for insertion into the hole and the sheet metal deforming position. A quick release lock pin may be utilized for locking the housings together in these positions. The inner housing preferably has means for receiving a pulling device for exerting a pulling device which is transmitted through the lock pin to the outer housing, and by the housings to the respective inner and outer members.

Another aspect of the invention is a quick disconnect lock pin utilized for locking the members together. The lock pin has an axial bore at one end and a diametrically extending hole adjacent that end and communicating with the axial bore. A curved wire depression spring is positioned within the axial bore and has a pair of tong-like protusions which extend through the diametrical openings and act as detents. An axial push or pull through a cooperating pin receiving hole depresses the protrusions to the diameter of the pin for permitting rapid insertion and removal of the pin from the cooperating pin receiving hole in the housings to be locked. The other end of the pin may have a fixed axial restraint member.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
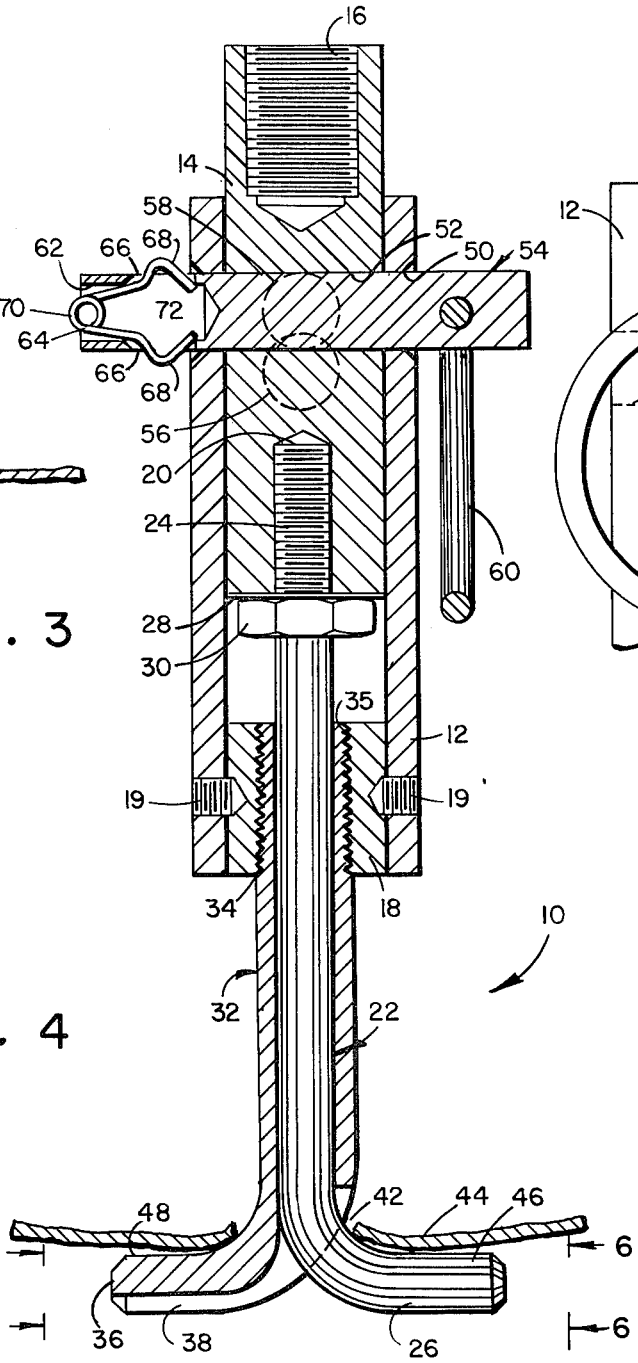
FIG. 1 is a vertical cross-sectional view taken substantially through a sheet metal indentation straightening tool constructed in accordance with the principles of the present invention with the working members in the extended position within a hole formed in the sheet metal.
Figure 6:
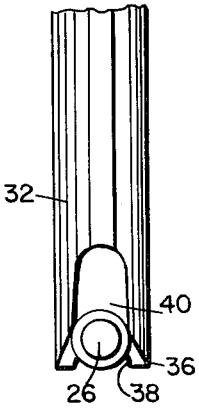
FIG. 6 is a view similar to FIG. 5, but as viewed from the right side of FIG. 1.

Referring now to the drawings, the preferred embodiment of a sheet metal indentation straightening or dent pulling tool 10 constructed in accordance with the principles of the present invention comprises an outer housing 12, within which an inner housing or puller bar 14 is disposed for axial transitory movement and for rotary movement about the longitudinal axis common to the housings 12 and 14. Preferably both housings 12 and 14 are cylindrical in shape, the outer housing 12 being a tubular member of sufficient wall thickness and having an inner diameter slightly greater than the outer diameter of the inner housing 14 which may be a solid rod slidably journalled within the outer housing. The upper end of the inner housing 14 extends out the upper end of the outer housing 12, and includes means for securing a pulling load device. In the preferred embodiment this means may simply be a tapped axial hole 16 which may threadily receive a threaded attachment for a knocker bar device (not illustrated) or a pulling hook device (not illustrated). As illustrated in FIG. 1, and for purposes that will become apparent, the bottom of the inner housing 14 is spaced from the lower end of the outer housing 12 for permitting sufficient clearance for axial movement of the inner housing relative to a lock ring 18 fastened within the outer housing at the lower end thereof by means of press fit pins or set screws 19.

Formed axially in the lower end of the inner housing 14 is a tapped hole 20 which threadedly receives the end of a first work engaging member 22. The member 22 is a high strength heat treated elongated cylindrical rod of relatively small diameter having external threads 24 at one end and a work engaging arm or prong 26 at its other end. The prong 26, prior to heat treatment, is bent so as to be angularly disposed relative to the axis of elongation of the rod, and preferably at substantially a right angle thereto. The rod 22 is locked into the tapped hole 20 by means of a spring lock washer 28 compressed between the inner housing 14 and a jam nut 30 threaded onto the upper threaded end of the rod.

Disposed concentrically about the rod member 22 is a second high strength heat treated work engaging member 32, which is a hollow cylindrical rod having an inner diameter slightly larger than the outer diameter of the rod 22 to permit the rod 22 to move axially and rotatably therein, but is shorter than the rod 22 so that the rod 22 may extend out the end thereof. The upper end of the hollow rod 32 has external threads 34 formed thereon and is threadily received within a tapped bore in the lock ring 18, the upper end of the threads may be deformed or upset at 35 after the rod 32 is secured to the locking ring 18 to prevent unthreading of these elements from one another. The lower end of the hollow rod 32, has a second work engaging arm or prong 36 bent so as to be angularly disposed relative to the axis of elongation at an angle substantially equal to that to which the prong 26 of the rod is bent. Moreover, the prong 36 is machined along the surface of the larger surface of the bend, i.e., the lower surface as illustrated in the drawings so as to form an arcuate recess 38 of substantially the same or slightly larger radial arc than the radius of the rod 22 so that a portion of the prong 26 may be nestled therein, that portion being the upper portion of the prong 26. At the junction of the recess 38 an internal radius is machined as at 40 to blend the recess 38 into the hollow of the rod 32. Preferably, when the prong 26 is nestled within the recess 38 the overall diametrical section through the angularly offset lengths of the prongs 26 and 36 does not exceed the outer diameter of the hollow rod 32, and ideally is substantially equal thereto, as illustrated in FIG. 4.

Figure 3:
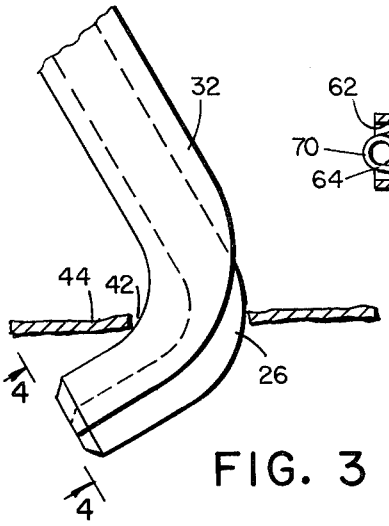
FIG. 3 is a fragmentary elevational view of the working members in the hole entering dispositon.
Figure 2:
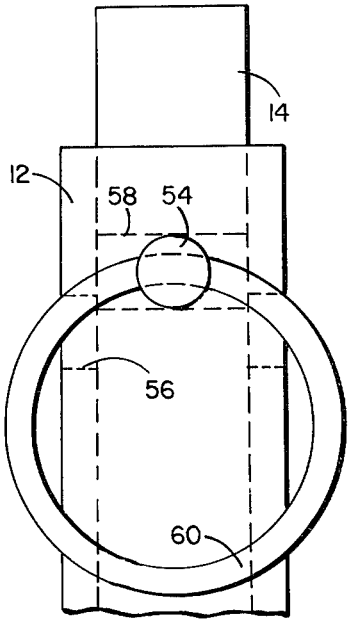
FIG. 2 is a fragmentary elevational view of a portion thereof.

It should be understood that the inner housing 14 together with the inner rod member 22 may be translated along the concentric axis of the inner and outer housings 12 and 14, and may be rotated relatively thereto. Thus, the prong 26 may be disposed in a first position within the recess 38 and in this position the prongs 26 and 36 may be inserted together as a unit within a hole 42 of slightly larger diameter than the rod 32 made within the dented sheet metal 44 as illustrated in FIG. 3. Moreover, the inner housing 14 may thereafter be moved downwardly relatively to the outer housing 12 to remove the prong 26 from the recess 38 and separate the prongs 26, 36. Once the prongs are separated, the inner housing may be rotated 180 degrees so that the prongs 26, 36 are disposed oppositely to one another, and the inner housing may thereafter be moved upwardly relative to the outer housing so that the work engaging surfaces 46, 48 of the respective prongs 26, 36 are substantially coplanar to engage the sheet metal across the hole 42 as a unit.

To lock the prongs 26, 36 at the proper relative dispositions for straightening the sheet metal, a respective hole 50, 52 is formed diametrically through the respective outer and inner housings 12, 14 at relative axial and radial locations where the prongs 26, 36 are oppositely disposed to each other and the surfaces 46, 48 are substantially coplanar. A lock pin 54 is thereafter inserted through both holes 50, 52. Thus, after the prongs are inserted into the blind side of the sheet metal through the hole 42, the inner housing is moved downwardly, rotated 180 degrees and lifted until the holes 50 and 52 are aligned, and the pin 54 is inserted therethrough. Although not essential, it is desirable that the housings also be locked together in the disposition where the prong 26 is nestled within the recess 38 of the prong 36. Thus, a second set of holes 56, 58 may be formed through the outer and inner housings 12, 14 at this disposition of the prongs 26, 36. Since the difference in elevation of the surfaces 46, 48 of the prongs 26, 36 is relatively small—because the diameter of the rod 32 is relatively small—the axis of the holes 56, 58 are slightly above or below (as illustrated) the holes 50, 52, and overlap slightly. Thus, to eliminate the inaccuracies of a slot which would occur if the holes 50, 52 were parallel to the holes 56, 58, the holes 56, 58 are drilled 90 degrees circumferentially from the holes 50, 52.

Figure 4:
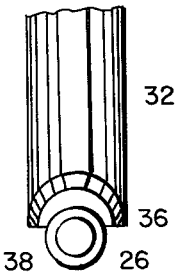
FIG. 4 is an end elevational view of the working members in the disposition illustrated in FIG. 3.
Figure 5:
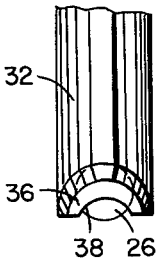
FIG. 5 is an end elevational view of the working members in the extended position as viewed from the left side of FIG. 1.

Inasmuch as it is desired for the lock pin 54 to lock the parts together in both the insertion/retraction position of FIGS. 3 and 4 and the open or working position of FIG. 1, the lock pin should be readily insertable through and retractable from the respective sets of holes 50, 52 and 56, 58 when required, but should not slip out of the holes inadvertently. To this end, the lock pin 54 is a detent type pin having an outside diameter slightly smaller than the holes 50, 52, 56, 58, and has a unique construction, as hereinafter described. One end of the pin includes a fixed axial restraint device such as a ring 60 slip fit into the lock pin 54, or maybe a snap ring, pin, or a threaded nut or similar means to restrain that end of the pin 54 from inadvertently entering the holes in the housings 12, 14.

The other end of the lock pin 54 has an axial bore 62 extending a distance therein for receiving a spring clip 64. A radial hole 66 is formed through the pin intermediate the ends of the hole 62 so as to communicate therewith. The spring clip 64 is formed from spring wire and has a pair of opposed prong like protrusions 68 bent away in an arcuate manner from the plane extending intermediate the protrusions and the coiled closed end 70 of the spring. The free ends 72 of the spring are deflected back toward the central plane, and may be compressed toward each other for insertion of the spring into the pin 54. The protrusions 68 are normally spaced apart by an amount greater than that of the diameter of the pin 54 while the free ends 72 are normally spaced a distance smaller than the diameter of the pin 54. The spring may be compressed by squeezing the protrusions 68 toward each other and the compressed spring is inserted into the bore 62 until the protrusions 68 are deflected out to the hole 66 which locks the spring in the pin 54. Moreover, preferably the free ends 72 are disposed longitudinally beyond the edge of the holes 66 remote from the open end of the pin 54 so as to act against the inner diameter of the hole 62 beyond the holes 66. Consequently, the protrusion 68 will prevent the pin 54 from axially working out of the holes 50, 52, 56, 58.

When the pin 54 is to be inserted or retracted from the hole an axial push or pull on the pin 54 will depress the protrusions 68 until they are spaced apart by a distance substantially equal to that of the diameter of the pin 54 thereby facilitating rapid insertion and removal of the pin 54 from the cooperating holes. By chamfering the entry to the holes 50 and 56 entry of the pin 54 therein will be facilitated. Since the spring is smoothly formed at the leading and trailing portions thereof adjacent the maximum diameter at the protrusions 68, the spring will be readily compressed upon both insertion and removal of the pin 54 into the cooperating locking holes.

To assemble the dent straightening device, the member 22 is inserted into the member 32 from the bottom thereof. The lock ring 18 is thereafter threaded onto the threaded end of the member 32, and the nut 30 is thereafter threaded onto the threads 24 until it jams at the ends of the thread. The lock washer 28 is thereafter inserted onto the top of the nut 32 and the inner housing 14 is then threaded onto the threads 24 until the lock washer 28 is fully depressed. The inner housing 14 is thereafter inserted into the outer housing until the lower end of the housing 12 and the lock ring 18 are substantially aligned. The outer housing is then rotated about the assembly until the pin 54 can be inserted into the matching lock pin holes 50, 52. The set screws 19 or the like are thereafter inserted to secure the outer housing to the lock ring.

In operation of the device, the work engaging members 26 and 36 may be aligned for insertion into the hole 42 by rotating the inner housing 14 with respect to the outer housing 12 until the prong 26 is aligned with the prong 36. The inner housing is then lifted relative to the outer housing to nestle the prong 26 within the recess 38 of the prong 36, and the prongs may thereafter be inserted into the hole 42 made in the sheet metal as illustrated in FIG. 3. Once the prongs are within the hole, the inner housing is depressed relative to the outer housing and rotated 180 degrees so that the prongs 26 and 36 are disposed in opposite directions. The inner housing is then lifted relative to the outer housing until the holes 50 and 52 are aligned and the locking pin 54 is inserted therethrough. When so disposed the top of the prongs 26 and 36 are substantially co-planar. A pulling load device is then secured to the upper end of the inner housing at 16 and the load is applied to pull the sheet metal 44 outwardly across the opposite sides of the hole 42. To remove the device from the hole 42, the locking pin 54 is removed from the holes 50, 52 and the above sequence is reversed. The locking pin may thereafter be inserted into the holes 56, 58 when aligned and the prongs removed from the hole 42.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A tool for straightening indentations in sheet metal comprising, an inner rod and an outer rod, each rod having a first leg elongated along a first axis and a second leg elongated along a second axis disposed angularly at substantially the same angle to the respective first axis, means defining a hollow in the first leg of one of said rods, the first leg of the other rod being disposed within said hollow leg for axial and angular movement relative thereto, the first leg of the inner rod being longer than the hollow leg so as to extend axially out the end thereof, a first housing, means for fastening the hollow leg to said housing, a second housing, means for fastening the end of the first leg of the inner rod to said second housing, means for mounting said first and second housing for movement relative to each other along and about said first axis, whereby the second legs may be disposed in a first position extending in the same direction and a second position extending oppositely to one another, means defining an elongated recess in the second leg of said outer rod and opening onto the surface of the hollow leg opposed to the direction of elongation of said second leg for receiving at least an adjacent surface portion of the second leg of said inner rod when said second legs are disposed in abutting relationship in said first position, whereby said second leg of the inner rod may be nestled within the second leg of the outer rod to provide a cross-sectional profile less than the composite of the two rods and both said second legs may be inserted and removed as a unit into and from a hole formed in the sheet metal, and locking means for securing said first and second housings together when said second legs are in said second position, whereby a pulling force may be applied to one of said housings for pulling said second legs against the sheet metal at diametrically opposed positions across said hole.

2. A tool as recited in claim 1, wherein said rods each have a substantially circular cross-sectional configuration and are concentric about said first axis.

3. A tool as recited in claim 1, wherein said angle is substantially 90 degrees.

4. A tool as recited in claim 1, wherein said locking means comprises a first hole extending through said first housing, a second hole extending through said second housing aligned with said first hole when said housings are in said second position, and a lock pin extending through said first and second holes.

5. A tool as recited in claim 4, including a third hole extending through said first housing, a fourth hole extending through said second housing, said third and fourth hole being aligned when said second legs are in said first position for receiving said lock pin to lock said first and second housings together when the second legs are inserted into and removed from the hole in the sheet metal.

6. A tool as recited in claim 4, wherein said pin has a spring detent extending diametrically therefrom, said spring being compressibly depressed when inserted into said first and second holes.

7. A tool as recited in claim 5, wherein said pin has a spring detent extending diametrically therefrom, said spring being compressibly depressed when inserted into said third and fourth holes.

8. A tool as recited in claim 4, wherein said first and second holes are aligned when said first and second legs engage the sheet metal along a common plane.

9. A tool as recited in claim 6, wherein said pin comprises an axial bore opening at one end thereof, a radial bore extending diametrically through said pin and communicating with said axial bore adjacent to said one end, said spring comprising a wire bent into a configuration having a closed end and a pair of free ends, and having a protrusion adjacent each free end, said protrusions being spaced apart a distance greater than the diameter of said pin, said spring being disposed within said axial bore with said protrusions extending through said radial bore.

10. A tool as recited in claim 7, wherein said pin comprises an axial bore opening at one end thereof, a radial bore extending diametrically through said pin and communicating with said axial bore adjacent to said one end, said spring comprising a wire bent into a configuration having a closed end and a pair of free ends, and having a protrusion adjacent each free end, said protrusions being spaced apart a distance greater than the diameter of said pin, said spring being disposed within said axial bore with said protrusions extending through said radial bore.

11. A tool as recited in claim 1, wherein said inner housing includes means for securing a pulling force applying device thereto.

12. A tool as recited in claim 2, wherein said recess has an arcuate configuration substantially equal to that of the inner rod.

13. A tool as recited in claim 2, wherein said second legs are substantially the same length, and said recess extends the full length of the second leg of said outer rod.

14. A tool as recited in claim 1, werein said first housing comprises a hollow cylindrical member and said second housing comprises a cylindrical member disposed within said first housing and journally moveable relatively thereto.

15. A tool as recited in claim 14, wherein said means for fastening the hollow leg of the outer rod to the first housing comprises a locking ring fastened within the hollow of the first housing, and threaded means for securing said locking ring to said hollow leg.

16. A tool as recited in claim 15, wherein said means for fastening the end of the first leg of the inner rod to said second housing comprises threaded means.

17. A tool as recited in claim 2, wherein said recess has an arcuate configuration substantially conforming to that of the second leg of said inner rod.

18. A tool for straightening indentations in sheet metal comprising, a pair of rods concentrically mounted about a common axis, the outer rod being hollow, the inner rod being longer than the outer rod and extending therethrough, each rod having a work engaging arm, each arm being disposed angularly at substantially the same angle to the axis, said rods being pivotable relatively to one another about said axis from a disposition wherein said arms are superposed one above the other to a disposition wherein said arms face oppositely to one another, and means for fastening a pulling force applying means to said inner rod along said common axis.

* * * * *